United States Patent [19]

Wiesmann

[11] 4,135,691

[45] Jan. 23, 1979

[54] FOLDING LEG ASSEMBLY

[76] Inventor: Herbert L. Wiesmann, Ohmstr. 28, 5620 Velbert 1, Fed. Rep. of Germany

[21] Appl. No.: 825,090

[22] Filed: Aug. 16, 1977

[30] Foreign Application Priority Data

Jul. 24, 1976 [DE] Fed. Rep. of Germany ..... 2633388

[51] Int. Cl.[2] ..... F16M 11/38; A47B 3/00

[52] U.S. Cl. ..... 248/188.6; 108/129; 248/439

[58] Field of Search ..... 108/121, 122, 125, 129–133; 248/166, 188, 168, 169, 188.6, 439; 403/122, 127, 132, 133, 141, 142

[56] References Cited

U.S. PATENT DOCUMENTS

| | | | |
|---|---|---|---|
| 1,812,967 | 7/1931 | Long | 248/188 X |
| 2,333,784 | 11/1943 | Harris | 108/129 |
| 2,796,268 | 6/1957 | Larson | 108/129 X |
| 3,233,701 | 2/1966 | Hentzi et al. | 182/155 |

*Primary Examiner*—James C. Mitchell

*Attorney, Agent, or Firm*—Brumbaugh, Graves, Donohue & Raymond

[57] ABSTRACT

An improved folding leg assembly includes a trestle attached to the underside of a table top and a pair of legs articulated to the trestle in such a manner that the legs may be folded against the underside of the table top. To permit their articulation, one end of each leg has a rounded head or ball which is rotatably mounted in a corresponding socket, the legs being braced by troughed ends of a generally C-shaped web attached to the trestle formed in the trestle. The swing of the legs may be limited by guide slits provided in the sockets.

29 Claims, 8 Drawing Figures

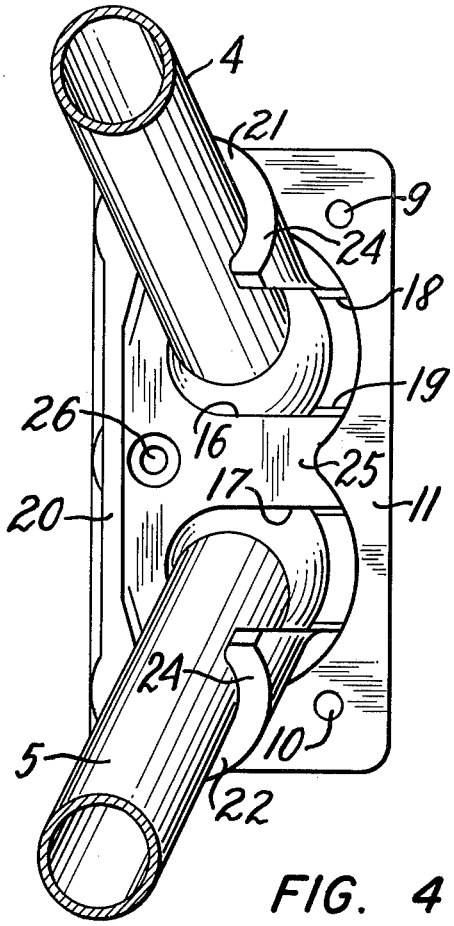
FIG. 4
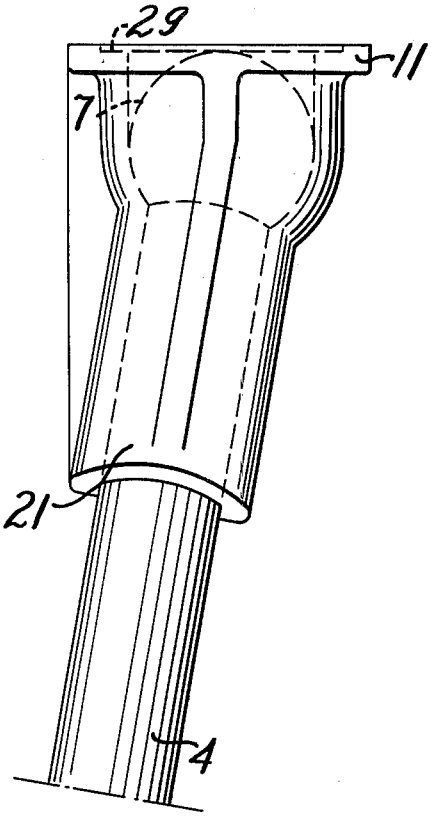
FIG. 5
FIG. 3
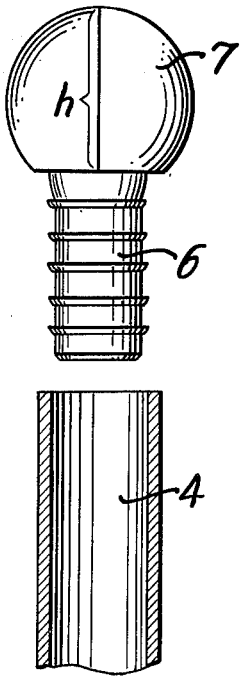

FOLDING LEG ASSEMBLY

FIELD OF THE INVENTION

The present invention relates to folding leg assemblies, and, more particularly, to folding leg assemblies for tables or the like.

BACKGROUND OF THE INVENTION

Folding leg assemblies are known which consist of a trestle adapted for attachment to the underside of a table top and a pair of legs articulated to the trestle. In use, the legs are spread apart. When not in use, the legs can be folded against the underside of the table top.

Such leg assemblies are ordinarily used in pairs or multiples to serve as substructures for tables, benches, collapsible stands, ironing boards, camp furniture, tables with folding tops, ping pong tables and the like. Alternatively, however, the assemblies may serve as end supports for extensible or foldaway table tops. The term "table" as used herein refers to all of the above-identified examples collectively.

Although the leg assemblies permit a table to be collapsed into a very small space, a critical feature of tables provided with folding legs is that when the legs are extended the table is not entirely rigid, but tends to shake due to play in the joints. The shaking can be so bad that even under slight impact drinks, for example, are spilled. While the intrinsic stability of the table can be improved by minimizing play in the joints and/or adding securing or bracing members, the minimization of play on the joints and/or the addition of bracing members increases construction costs, while decreasing handling convenience.

SUMMARY OF THE INVENTION

In accordance with the invention, there is provided a novel and improved leg assembly which normally includes a trestle adapted for attachment to the underside of a table top and a pair of legs articulated to the trestle in such a manner that the legs may be folded against the underside of the table top. In the leg assembly of the present invention, each leg is provided at one end with a rounded head or ball, which seats in a corresponding socket formed in the trestle. The ball cavities of the sockets have a depth not greater than the diameter of the balls. The sockets of the trestle, which may be advantageously formed from synthetic material, are provided with guide slits for limiting the swing of the legs.

The leg assembly according to the invention is distinguished by a number of desirable features and advantages. First, it consists of only a few parts, which are economical to make and convenient to assemble and manipulate. High stability and wear resistance may be imparted to the parts without unduly increasing construction costs and time. Second, the balls fit into the sockets with little or no play at all. To minimize play, the depth of the socket cavities is made somewhat smaller than the diameter of the balls, so that the balls (after attachment to the table top) are clamped between the sockets and the underside of the table top or an intermediate layer. By this construction, any joint play in the vertical direction is prevented, the legs being movable only in the direction defined by the guide slit.

Due to their spread, however, the extended legs are biased in the direction of their extreme position by the weight of the table itself. Under impact, of course, the extended legs may slightly and momentarily depart from their extreme position, causing the table to shake or swing. To exclude this possibility, in one embodiment of the invention, the trestle is provided with elastic retaining projections, which are traversed by the legs and clamp them into their extreme position. The retaining projections associated with the extreme extended position of the legs, in conjunction with the taut insertion of the balls in the sockets, provide the table or frame with an intrinsic rigidity and stability comparable to those of a table with fixed legs. The retaining projections associated with the extreme folded position of the legs will, for example, prevent the folded legs of a table placed against a wall from accidentally dropping out into the room.

According to further advantageous features of the invention, a web having a generally C-shaped cross section, embracing the two sockets and opening towards the retracting side of the legs, may be molded to the underside of the trestle. The curved, troughed ends of the web diverge downward and support the extended legs. The laterally inner surface of the troughed ends has a shape which matches the shape of a portion of the laterally outer surface of the legs over an extended substantially continuous longitudinal length of the legs, the laterally inner surface of the troughed ends being contiguous with the matching portion of the laterally outer surface of the legs when they are in their extended positions. By this construction, the legs are supported over a large area by the troughed ends in their extreme extended position. Furthermore, the two troughed ends are supported in a stable position by the web, which acts as a tension member, and form an intrinsically firm abutment for the spread folding legs, not yielding even to a heavy load on the table.

Advantageously, a pair of the retaining projections, adapted to clamp around the extended legs, may be molded to the bottom of the troughed ends so that their retaining force will act on the extended legs with a comparatively long lever arm. This prevents the legs from inadvertently swinging back into their initial position.

According to the invention, the top of the trestle can be in the form of a plate adapted to be screwed in place. The C-shaped web may be inclined obliquely outward away from the retracting side of the trestle, being joined to the plate by a rib arranged between the two sockets. In this way, when the legs are inclined outward in lengthwise direction of the table as well as in widthwise direction, the web is prevented from yielding in the lengthwise direction of the table under heavy loads, inasmuch as the rib which acts as a tension member can withstand considerable force.

The assembly includes tubular legs, each leg having a ball of steel or synthetic material. The balls, which have a somewhat larger diameter than the tubular legs, are provided with a fixation shank adapted to fit onto the top of each leg. The attachment plate of the assembly, above each socket, is provided with an aperture having a diameter not less than the diameter of the balls, so that the tubular legs can be passed feet first through the sockets until the balls are shot home.

According to a further feature of the invention, a bearing plate may be provided to cover the openings in the attachment plate for the balls, so that the balls will not dig into the table top. If balls of synthetic material are used, the bearing plate may be a plain metal plate. If steel balls are used, the bearing plate can be made from a synthetic material with spherical indentations for the balls.

To support especially wide table tops, four leg assemblies, each with two legs, may be arranged near the corners of the table. If the table top is intended to support rather light loads, each leg assembly or trestle may be fitted with only one leg, preferably in each instance the one directed outward.

Alternatively, the trestle may consist of a pair of trestle parts, each the mirror image of the other. Each trestle part, which is adapted for attachment to the underside of the table top, has one socket and a corresponding leg. The trestle parts, now having only one leg each, are so arranged at the corners of the table top that their legs are spread in crosswise and lengthwise direction of the table. If a crosswise spread is not required, identical trestle parts may be used at all corners of the table top, in which case mirror image trestle parts may be dispensed with.

BRIEF DESCRIPTION OF THE DRAWINGS

For a better understanding of the invention, reference may be made to the following description of three exemplary embodiments, taken in conjunction with the figures of the accompanying drawings, in which:

FIG. 3 is an exploded view of the top of a leg and a corresponding ball;

FIG. 4 is a bottom view of the assembly of FIG. 2;

FIG. 5 is a side elevational view of the assembly of FIG. 2;

DESCRIPTION OF THE PREFERRED EMBODIMENTS

Figure 1:
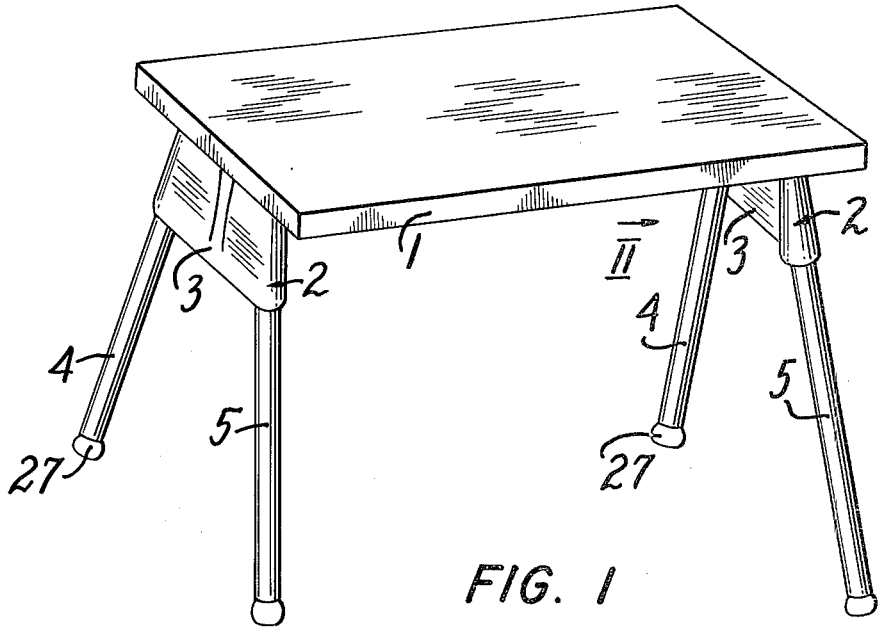
FIG. 1 is a perspective view of a table showing one embodiment of the present invention.
Figure 2:
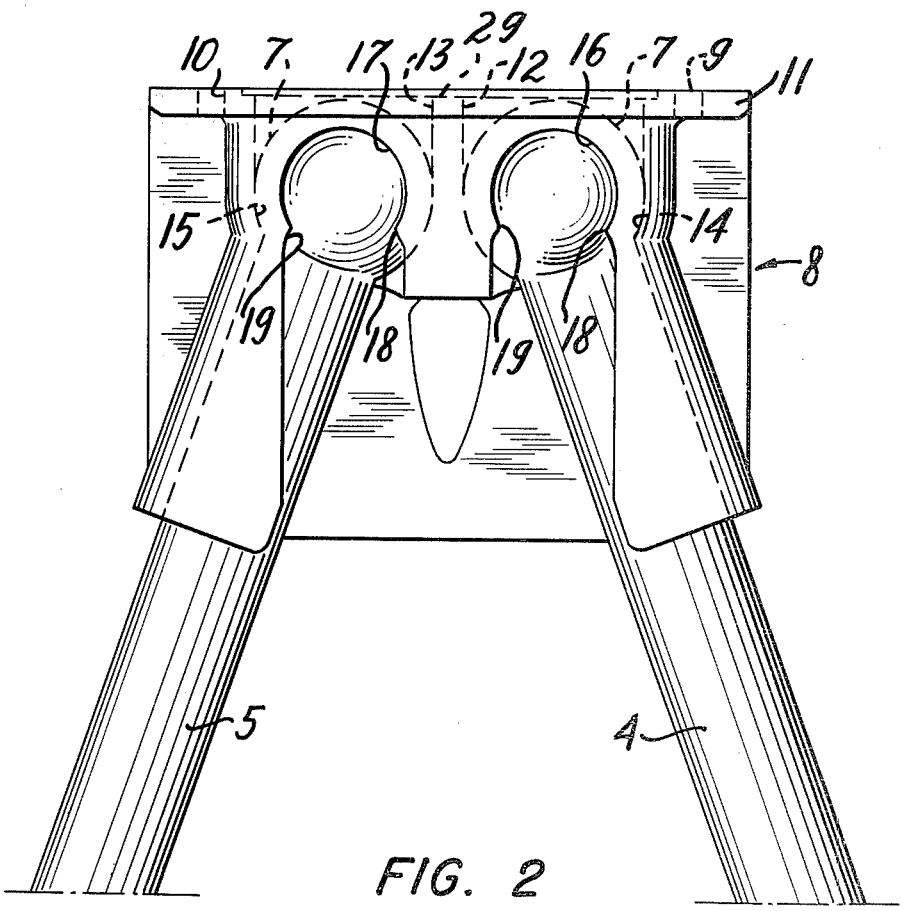
FIG. 2 is an elevational view of an assembly, viewed in the direction of the arrow II in FIG. 1, but with a narrower trestle than that of the embodiment of FIG. 1.
Figure 6:
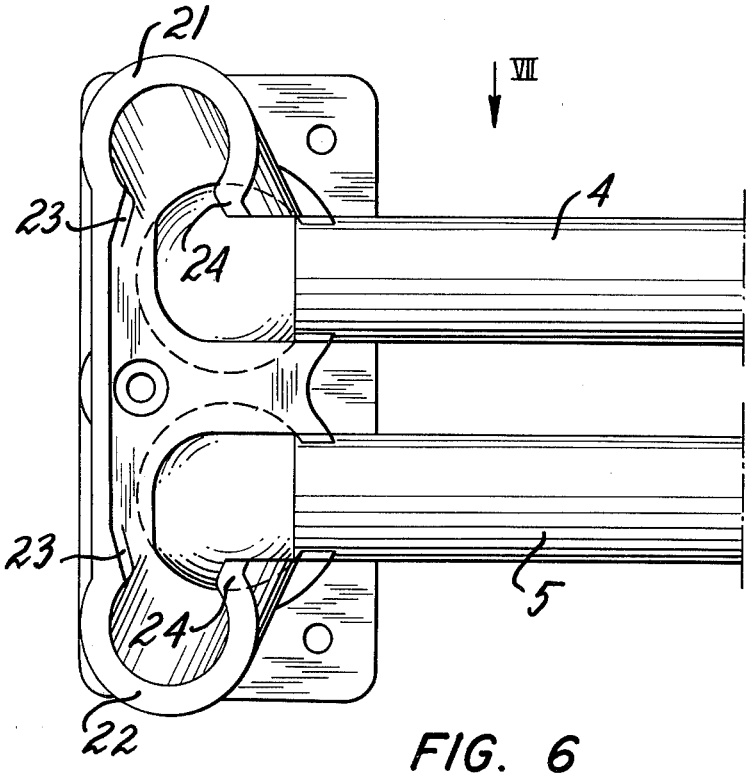
FIG. 6 is a bottom view of the assembly of FIG. 4, but with the legs folded up.

Referring to FIG. 1, there is shown a table or folding stand which is provided with two leg assemblies 2 attached to the underside of a table top 1. Each assembly 2 has a trestle 3 of synthetic material screwed to the table top 1 and two legs 4 and 5, which are capable of being folded from the extended position shown, first inward towards each other and then flat against the table top 1.

Referring now to FIG. 3, the legs 4 and 5 are tubular members. A ball 7 has a molded on shank 6, which is adapted for insertion into the top of the legs. In the embodiment of FIG. 3, the ball 7 consists of synthetic material.

FIGS. 2 and 4–7 illustrate a leg assembly whose trestle 8 is narrower than the trestles 3 of FIG. 1, but whose construction is otherwise similar to that of the embodiment of FIG. 1. The trestle 8, which can be molded in one piece, has an upper attachment plate 11 provided with two screw holes 9 and 10 and two openings 12 and 13 of a diameter equal to the diameter of the balls 7. On the underside of the plate 11, one below each opening 12 and 13, two sockets 14 and 15 are molded on, each socket having the same radius of curvature as the balls 7. The sockets 14 and 15 are provided with guide slits 16 and 17, respectively, having a width equal to the diameter of the tubular legs 4 and 5. The guide slits 16 and 17 bound the path of swing when the legs 4 and 5 are moved from an extended position (see FIGS. 2, 4 and 5) to a folded position (see FIGS. 6 and 7). The open end of each guide slit 16 and 17 includes two opposed elastic retaining projections 18 and 19, which are molded onto the walls of the slits. The projections 18 and 19, which are capable of being traversed by the legs, clamp the legs behind them when the legs are in their extended position and arrest the legs when the legs are in their folded position.

On the underside of trestle 8, a web 20 is molded on. The web 20 is generally C-shaped in horizontal cross section so as to embrace the two sockets 14 and 15. The C-shaped web 20 opens towards the direction of retraction of the legs with its curved troughed ends 21 and 22 diverging downward to support the extended legs over a large area. At the bottom of each of the troughed ends 21 and 22, a pair of retaining projections 23 and 24 are formed, clamping behind the legs when they are in their extended position to retain the legs firmly in their extended position. The web 20 thus forms a tension member between the two troughed ends 21 and 22, thereby preventing any lateral yielding of the two ends when the table supports a load of considerable weight. The web 20 is directed obliquely outward and downward to accommodate the extended legs when they are spread in a lengthwise direction (see FIG. 1). A rib 25 arranged between the two sockets connects the web 20 to the attachment plate 11. An additional screw hole 26 is provided in the rib 25 for fastening the trestle to a table top or the like.

Figure 7:
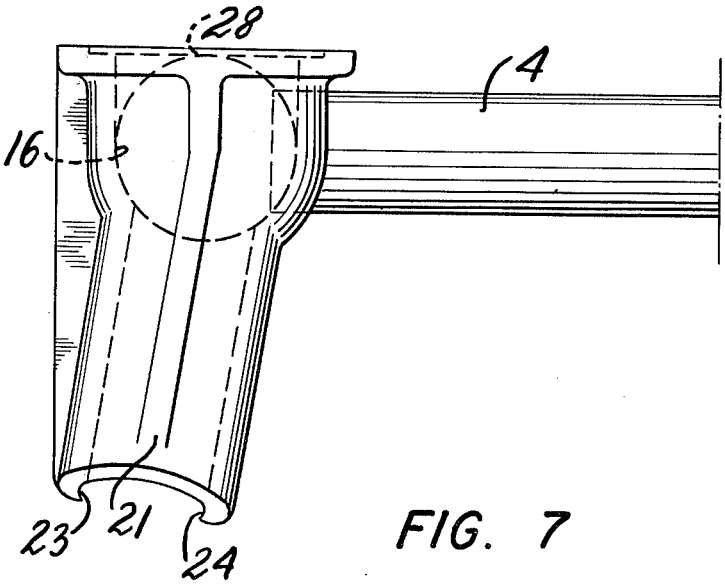
FIG. 7 is an elevational view of the assembly of FIG. 6, viewed in the direction of the arrow VII.

In assembling the leg assembly, the legs 4 and 5, already fitted with their balls 7 but not as yet with any feet or ferrules 27, are inserted feetfirst through the openings 12 and 13 in the attachment plate 11 of the trestle and through the guide slits 16 and 17 of the sockets until the balls 7 are hung in the sockets 14 and 15. Then the assembly, after interposition of a bearing plate covering the two openings 12 and 13, is screwed to the underside of the table. In the embodiment of FIG. 7, the bearing plate consists of a plain sheet of metal inlaid flush in a recess 29 (compare FIGS. 5 and 7) of the trestle attachment plate 11. The depth of the ball cavities of sockets 14 and 15, measured from the underside of the metal plate 28 or recess 29, is equal to or preferably somewhat less than the diameter of the balls 7 or, in the case of the embodiment of FIG. 3, the height (h) of the balls 7, so that after the trestle has been screwed in place the balls are trapped with little or no play between the sockets and the bearing plate.

The invention is not limited to the embodiments represented in FIGS. 1–7. For example, the trestle may be screwed to the table top with interposition of a channel embracing the attachment plate 11, in which case the attachment plate 11 will be thinner by the depth of the recess 29. When steel balls are used, it is desirable to utilize a bearing plate made of synthetic material, which may be provided with spherical identations for the balls.

In the embodiment of FIGS. 2–7, the two sockets 14 and 15 are arranged comparatively close together. Alternatively, the sockets may be arranged a considerably greater distance apart, bringing them and thus the tops of the legs closer to the corners of the table, thereby further increasing the intrinsic stability of a table provided with such leg assemblies. FIG. 1 shows trestles 3 with legs, and sockets which are considerably wider spaced, the width of the trestles approaching the width of the table top 1. The web of these trestles is preferably connected to the attachment plate by two ribs, each arranged adjacent a corresponding socket.

Figure 8:
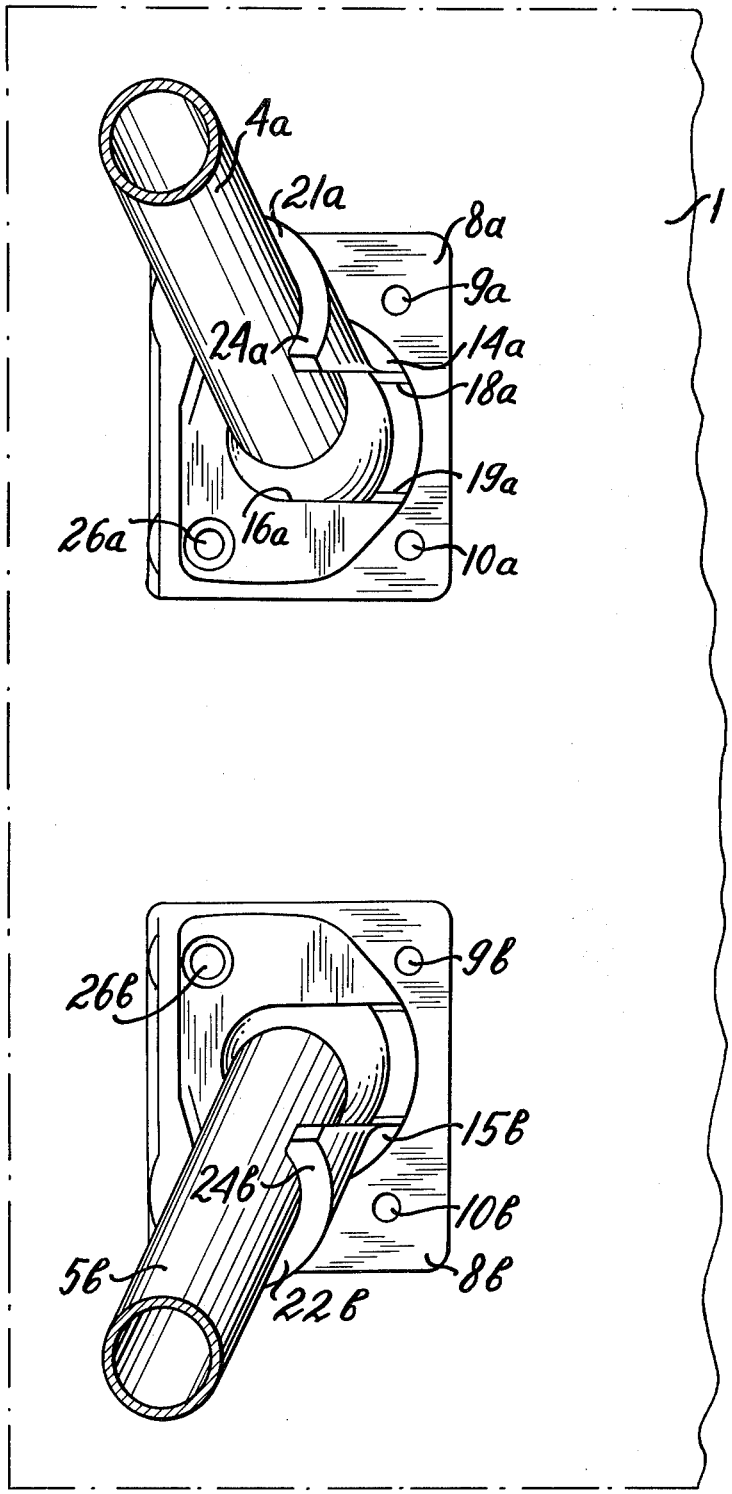
FIG. 8 is a bottom view of an alternate embodiment of the present invention.

With reference to the alternate embodiment depicted in FIG. 8, in which corresponding elements have been identified by like reference numerals with an "a" or "b" suffixed, there is shown a leg assembly having a trestle which has been subdivided into a pair of mirror image parts 8*a* and 8*b*. Each of the trestle parts 8*a* and 8*b* are provided with only one socket 14*a* and 15*b*, respectively, for the corresponding legs 4*a* and 5*b*. Holes 9*a*, 10*a* and 26*a* in the trestle part 8*a* and holes 9*b*, 10*b* and 26*b* in the trestle part 8*b* are provided, so that the trestle parts can be screwed to the table top 1.

It will be understood that the above-described embodiments are merely exemplary and that persons skilled in the art may make many variations and modifications without departing from the spirit and scope of the invention. All such modifications and variations are intended to be included within the scope of the invention as defined in the appended claims.

What is claimed is:

1. A folding leg assembly including a leg, having a ball at one end thereof; a trestle, having a socket for receiving the ball of the leg in such a manner that the leg can swing from an extended position to a folded position and a guide slit communicating with the socket for defining the path of swing when the leg is swung from its extended position to its folded position; and a trough-like member depending lengthwise from the trestle and partially embracing the socket, the laterally inner surface of the trough-like member having a shape which matches the shape of a portion of the laterally outer surface of the leg over an extended substantially continuous longitudinal length of the leg and being contiguous with the matching portion of the laterally outer surface of the leg when it is in its extended position, whereby the trough-like member braces the leg against inadvertent movement in a generally lateral direction when the leg is in its extended position.

2. A leg assembly according to claim 1, wherein the trough-like member includes means for releasably retaining the leg in its extended position.

3. A leg assembly according to claim 2, wherein the retaining means includes a pair of resilient projections on the trough-like member, the projections forming a part of the laterally inner surface of the trough-like member and extending around the leg, when it is in its extended position, a sufficient distance to clamp the leg in its extended position.

4. A leg assembly according to claim 3, wherein the projections are formed monolithically with the trough-like member.

5. A leg assembly according to claim 4, wherein the trestle is formed monolithically with the trough-like member.

6. A leg assembly according to claim 1, wherein the trestle includes means for releasably retaining the leg in its folded position.

7. A leg assembly according to claim 6, wherein the retaining means includes a pair of resilient projections depending from the trestle one on either side of the guide slit, the projections extending around the leg, when it is in its folded position, a distance sufficient to clamp the leg in its folded position.

8. A leg assembly according to claim 7, wherein the projections are formed monolithically with the trestle.

9. A leg assembly according to claim 8, wherein the trough-like member is formed monolithically with the trestle.

10. A leg assembly according to claim 1, wherein the trough-like member depends from the trestle at an oblique angle relative thereto.

11. A leg assembly according to claim 1, wherein the trough-like member is positioned so as not to interfere with the path of swing of the leg when the leg is swung from its extended position to its folded position.

12. A leg assembly according to claim 1, wherein the trestle is a plate adapted for attachment to the underside of a table top.

13. A leg assembly according to claim 1, wherein the socket has a depth not greater than the height of the ball as measured from the end of the ball adjacent to the leg to the opposite end of the ball when the ball is in the socket.

14. A leg assembly according to claim 1, wherein the folding leg assembly further comprises an additional leg, having a ball at one end thereof, an additional socket formed in the trestle for receiving the ball of the additional leg in such a manner that the additional leg can swing from an extended position to a folded position; an additional guide slit communicating with the additional socket for defining the path of swing when the additional leg is swung from its extended position to its folded position; and an additional trough-like member depending lengthwise from the trestle and partially embracing the additional socket, the laterally inner surface of the additional trough-like member having a shape which matches the shape of a portion of the laterally outer surface of the additional leg over an extended substantially continuous longitudinal length of the additional leg and being contiguous with the matching portion of the laterally outer surface of the additional leg when it is in its extended position, whereby the additional trough-like member braces the additional leg against inadvertent movement in a generally lateral direction when the additional leg is in its extended position.

15. A leg assembly according to claim 14, wherein adjacent portions of the trough-like members remote from their corresponding guide slits are attached by a web.

16. A leg assembly according to claim 15, wherein the web is formed monolithically with the trough-like members.

17. A leg assembly according to claim 16, wherein the trough-like members are formed monolithically with the trestle.

18. A leg assembly according to claim 14, wherein the trough-like members depend from the trestle at an oblique angle relative thereto.

19. A leg assembly according to claim 8, wherein the trough-like members diverge relative to each other, the distance between the trough-like members being the greatest when measured between the free ends thereof.

20. A leg assembly according to claim 14, wherein the trestle is a plate adapted for attachment to the underside of a table top.

21. A leg assembly according to claim 20, wherein the legs are positioned alongside each other when in their extended and folded positions, the legs, in their folded positions, being substantially parallel to the underside of a table top.

22. A leg assembly according to claim 21, wherein the swing paths of the legs are each greater than 90°.

23. A leg assembly according to claim 1, wherein the leg is tubular and the ball has a shank adapted to be force-fitted into the top of the leg.

24. A leg assembly according to claim 1 wherein the ball is made of steel.

25. A leg assembly according to claim 1, wherein the ball, trestle and trough-like member are made of synthetic material.

26. A leg assembly according to claim 12, wherein the attachment plate has an opening located over the socket, the diameter of the opening being at least equal to the diameter of the ball.

27. A leg assembly according to claim 26, further comprising a bearing plate for the balls, covering the opening in the attachment plate.

28. A leg assembly according to claim 27, wherein the bearing plate comprises a metal plate inlayed in a recess in the attachment plate.

29. A leg assembly according to claim 27, wherein the bearing plate is made of synthetic material and has a spherical indentation for the ball.

* * * * *

UNITED STATES PATENT OFFICE

CERTIFICATE OF CORRECTION

Patent No. 4,135,691 Dated January 23, 1979

Inventor(s) Herbert L. Wiesmann

It is certified that error appears in the above-identified patent and that said Letters Patent are hereby corrected as shown below:

Column 4, line 43, after "metal" insert --28--;

Column 6, line 55, "8" should read --18--.

Signed and Sealed this

First Day of May 1979

[SEAL]

Attest:

RUTH C. MASON
*Attesting Officer*

DONALD W. BANNER
*Commissioner of Patents and Trademarks*